US006196421B1

(12) United States Patent
Williams

(10) Patent No.: US 6,196,421 B1
(45) Date of Patent: Mar. 6, 2001

(54) DOUBLE ENDED AEROSOL DISPENSER FOR LIQUID PRODUCTS

(75) Inventor: David A. Williams, Gardnerville, NV (US)

(73) Assignee: Aervoe-Pacific Company, Inc., Gardnerville, NV (US)

( * ) Notice: Subject to any disclaimer, the term of this patent is extended or adjusted under 35 U.S.C. 154(b) by 0 days.

(21) Appl. No.: 09/115,079

(22) Filed: Jul. 14, 1998

(51) Int. Cl.[7] ..... B67D 5/52

(52) U.S. Cl. ..... 222/129; 222/135; 222/386.5; 222/402.1

(58) Field of Search ..... 222/129, 135, 222/386.5, 402.1

(56) References Cited

U.S. PATENT DOCUMENTS 2,947,449 * 8/1960 Hernandez ..... 222/94
3,045,925 * 7/1962 Giangualano ..... 239/306
3,211,343 * 10/1965 Silver ..... 222/144.5
5,746,354 * 5/1998 Perkins ..... 222/132

FOREIGN PATENT DOCUMENTS 379-627 * 8/1990 (EP) ..... 222/135
2649-383 * 1/1991 (FR) ..... 222/135
2650-570 * 2/1991 (FR) ..... 222/135

* cited by examiner

*Primary Examiner*—Henry J. Recla
*Assistant Examiner*—Peter deVore
(74) *Attorney, Agent, or Firm*—Mark C. Jacobs, Esq.

(57) ABSTRACT

An aerosol can having two terminal portions each with its own valve and product delivery head of various configurations is disclosed. The can may feature either one or two products for delivery, and can employ one or two volumes of propellant. The material to be delivered can be stored directly in the can or in one or two pouches, or in a combination mode of within the can directly and in one pouch, as may be desired. The same material can also be distributed in two different manners, such as fine mist or strong stream, the mode of delivery being spray head dependent.

24 Claims, 3 Drawing Sheets

DOUBLE ENDED AEROSOL DISPENSER FOR LIQUID PRODUCTS

FIELD OF THE INVENTION

This invention relates to aerosol cans, having two spray heads, one head at each end of the can to deliver a fluid product.

BACKGROUND OF THE INVENTION

Aerosol delivered paints, among other products, have been available in the marketplace for many years. One of the earliest known aerosol dispensers was that patented by Goodhue et al, U.S. Pat. No. 2,331,117 issued Oct. 5, 1943. Many advances have been made since the 1950s when aerosols were first commercially introduced. Typical of the more recent apparatuses for the delivery by aerosol is one as invented by lib: Paul O'Neill and disclosed in his patent, U.S. Pat. No. 5,507,420 issued Apr. 16, 1996. While the spray can, —another term commonly associated with aerosol cans, — of that patent is reusable, other patented spray cans are not. That is, after a one time distribution of the contents, the can is discarded.

This O'Neill patent and the plethora of others that pertain to spray paint cans, and other spray deliveries for fluids pertain to either new modes via delivery of propellant, new modes of storage of the vehicle, and/or new modes of the storage of the concentrate or fluid to be delivered by the vehicle (propellant).

The operating principle for an aerosol can is the presence of a liquefied or compressed gas such as butane or nitrogen, which may be partly liquefied by the internal pressure of the can exerts pressure on the product within the can. The nozzle when actuated, acts as a pressure release and product exits the nozzle. A layer of free gas is either above the liquid or gaseous product to be delivered, or along side and then introduced above the product to put pressure on the product to be delivered. When the valve is actuated, the pressure is relieved and the product comes up a dip tube connected to the valve to exit as a spray. Shaving cream cans which house a viscous liquid soap, work slightly differently. The differences need not be discussed here, since they are discussed supra.

A wide variety of products is available in the market place packaged in an aerosol delivery can. Thus mention can be made of whipped dairy cream and shaving cream, caulking compositions, aftershave and cologne, paint, air fresheners, body deodorants, cleaning compositions and many, many more.

Double delivery systems are not unknown in the world of technology. Thus a search of the prior art revealed the following fluid delivery systems that were double ended:

Chamberlain U.S. Pat. No. 2,080,602, issued May 18, 1937 discloses a desk top vessel that can be oriented either horizontally or vertically for fluid delivery though a pair of spouts.

Mahar U.S. Pat. No. 3,200,998 discloses a liquefied gas cylinder with a pair of valves, one to dispense liquefied gas in a liquefied state, and one to dispense it in a gaseous state.

Another patent that provides a double closure is that of Beres et al U.S. Pat. No. 3,283,785 issued Nov. 8, 1966. In this structure the two valve structures are different. Here one valve was a slide type valve and the other an abutting valve.

A more recent patent is, that of the Silvenis structure, U.S. Pat. No. 4,618,076 dated Oct. 21, 1986 for a dispensing bottle such as is utilized for household liquid cleaning agents. One valve is a valve to spray the contents, the other is an opening to permit pouring contents onto a rag or other surface. The Habora & Hail U.S. Pat. No. 5,541,581 issued Aug. 6, 1996 operates in like manner with different structure.

An ophthalmic solution dispenser having dual valves one for entry and one for egress is claimed in Allegretti, U.S. Pat. No. 5,002,206 issued Mar. 26, 1991. This is used for the introduction of a second ingredient into a chamber to be mixed with the contents of the chamber and then dispensed.

Even a double ended ketchup dispenser has been invented. See Ehrbar U.S. Pat. No. 5,421,488 issued Jun. 6, 1995.

Thus it is seen that in various industries there is indeed a need for a dual ended dispenser. However to date no double ended aerosol can is known to exist, yet the need for same is evident.

It is an object therefore of this invention, to provide an aerosol dispenser that is double ended; that is, has a spray head on both opposite ends of the can.

It is another object to provide an aerosol dispenser that has two dispensing tips each of which has a different spray pattern to deliver the same or different product.

It is still another object to provide an aerosol can that can deliver two different but related products from the same dispenser each through its own dispenser tip.

It is a yet further object to provide a dual ended aerosol dispenser which utilizes a single source of propellant.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A double ended aerosol spray can of various configurations is disclosed. The can may feature either one or two products for delivery, and can employ one or two volumes of propellant. The material to be delivered can be stored directly in the can or in a pouch(es) as may be desired or in a combination thereof. The same material can be divided into two portions and also the material can be distributed in two different manners, such as fine mist or strong stream, the mode of delivery being spray head dependent.

DESCRIPTION OF THE PREFERRED EMBODIMENT

Figure 1:
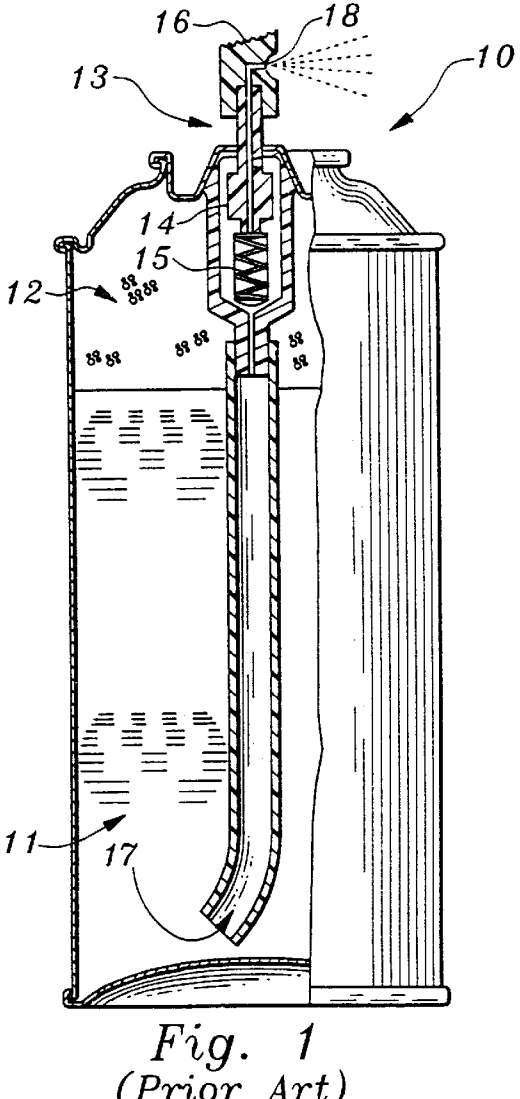
Fig. 1 (Prior Art)
FIG. 1 is a cutaway view of a typical prior art aerosol spray can, and is designated PRIOR ART.

While known in the art, it will be beneficial for the reader to understand the general operating principles of a conventional one product single ended aerosol can. Thus in FIG. 1, such a PRIOR ART unit is depicted.

A spray can, 10 is normally made of either tin-plate or aluminum. It includes a cylindrical body portion and an upper terminal section which is convex and attached around the periphery of the cylinder. It has a convex bottom closure section as well. The attachment of the two terminal sections is well documented in the art and need not be elaborated upon in detail.

At the top, there is a simple plastic valve to control the spray disposed within the upper terminal section. From the bottom of this valve, a flexible dip tube extends downwardly toward the bottom of the can, when a mist or spray is desired. For a stream delivery like product, the dip tube may be eliminated. The can is filled with the product 11, to be sprayed and the propellant, a gas such as butane or CO2, or a new non-CFC propellant 12, is added. The gas is partly liquefied by the pressure in the can, but there may be a layer of free gas above the liquid. As the can is emptied more of the liquefied gas vaporizes to fill the space.

The valve 13 is normally held shut by the pressure in the can, and by the coil spring, 15 directly below the valve stem, 14. When the push button spray head 16 is pressed, it forces the valve stem down in its housing, uncovering a small hole, not seen which leads up through the stem to the nozzle in the button. This allows the product to be forced up the dip tube 17, by the gas pressure in the can to exit out the orifice 18 of the spray head 16. The nozzle may be shaped to give a spray or a continuous stream as is known.

If it is desired to produce a fine mist, a propellant is employed which mixes with the product. The two leave the nozzle together and the propellant evaporates as soon as it reaches the air, thereby breaking the product into tiny droplets. The same technique when used with a more viscous liquid and a wider nozzle results in a foam. For a continuous stream of liquid, a non-mixing propellant is used, and the dip tube reaches into the product.

A different arrangement is used for cans containing very viscous substances. The product may be enclosed in a plastic bag attached to the underside of the valve and the propellant fills the space between the bag and the can. This stops the product from sticking to the sides of the can and allowing the propellant to escape up the dip tube. Cans of this type can be used upside down, whereas an ordinary can must be kept right side up such that the end of the dip tube remains in the product to be delivered.

Aerosol cans are filled on the production line by inserting the product, putting the lid (upper terminal portion) and valve on the can and forcing the propellant in backwards through the valve. The bag-type can, however, must be filled with propellant through a small extra valve in the base. All of this general information and more is well known to the practitioners in the aerosol industry.

Figure 3:
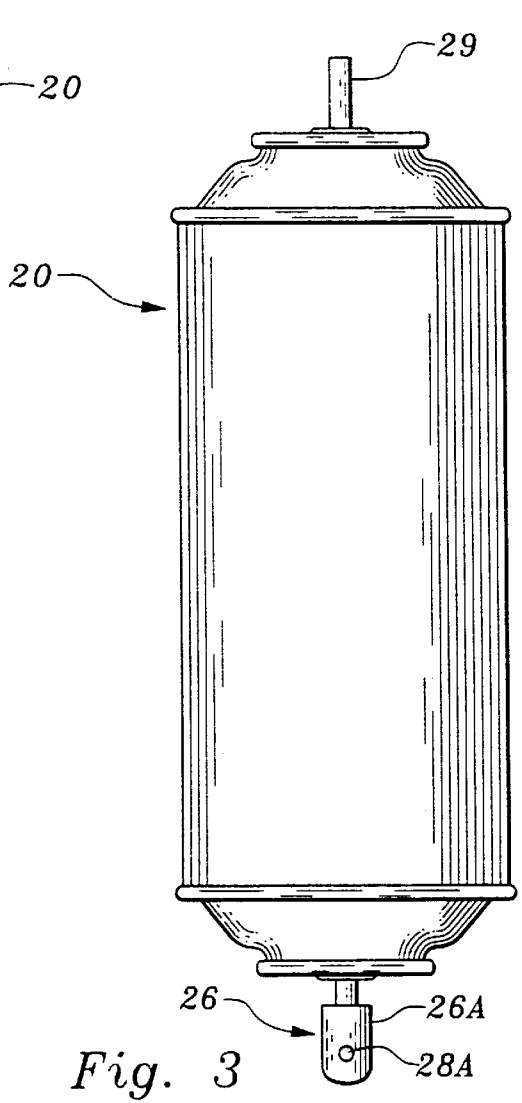
FIG. 3 is a side elevational view of a second embodiment of a double ended spray according to this invention.
Figure 2:
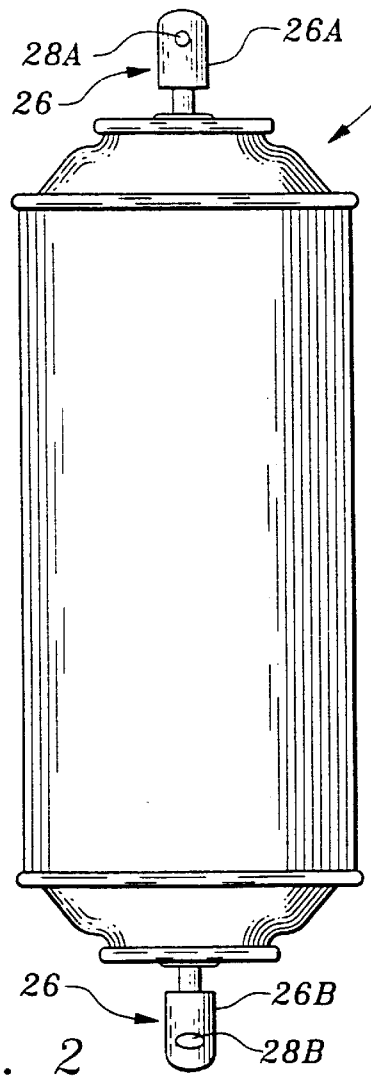
FIG. 2 is a side elevational view of a double ended spray can according to this invention.

FIGS. 2 and 3 are elevational views of the exterior of a double ended spray can 20, according to this invention. In FIG. 2, the can 20 features two mist or spray patterned heads 26A and 26B. The difference being the configuration of the openings 28A and 28B in the spray heads 26. In FIG. 3, however, the aerosol dispenser features a spray nozzle 29, at its upper end and a spray head 28A at its lower end. The mode of using each of these is well known in the art.

Figure 4:
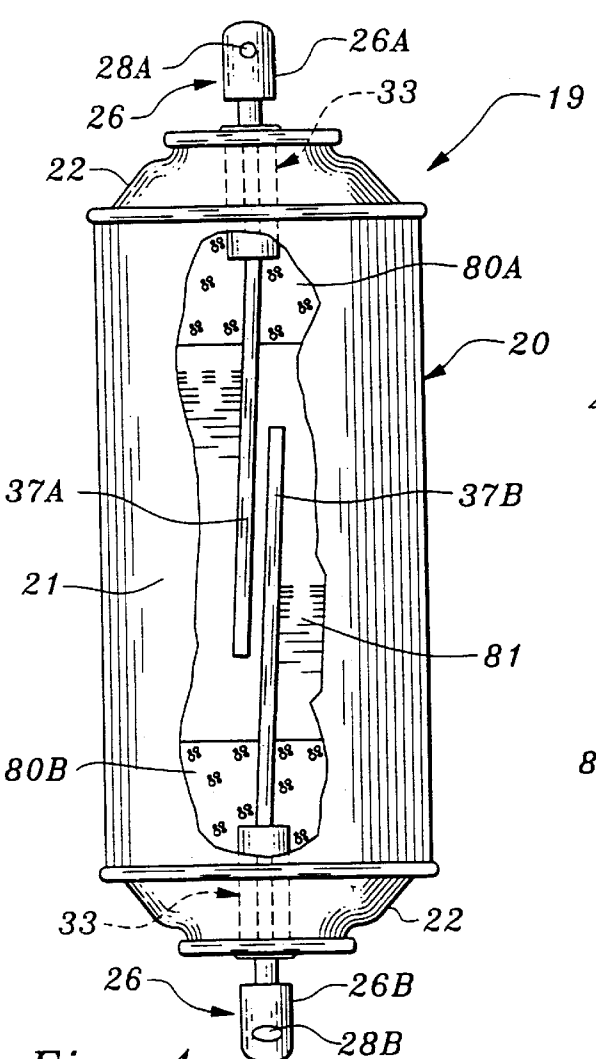
FIG. 4 is an elevational partially cutaway view of a spray can having a liquid product disposed between two layers of gaseous propellant and having two different nozzles.

The discussion now turns to the interior of the aerosol cans as first seen in FIG. 4. Here the first embodiment 19 includes a can 20 whose main body 21 has been cut away while the sealed termini 22 at the opposite ends have been left uncut. For ease of understanding and to avoid clutter, the details of the valve including the coil spring, and the connection of the dip tube to the valve, have been purposely eliminated from this and the following views since such aspects of the invention are deemed conventional.

Spray head 26A is seen to have a circular opening 28A disposed through a conventional valve 33 to a first dip tube 37A. As can be seen tube 37A terminates within the confines of the fluid product 81. Propellant layer 80A, which is any conventional propellant gas applies pressure upon the product 81 such that the product can be delivered in the usual manner. The circular orifice 28A will give rise to a fine mist delivery of the product 81.

Spray head 26B has an elongated orifice 28B and is adapted for a more fan like spray with larger droplets. This spray head 26B is connected via its own valve 33 to a dip tube 37B, which dip tube also terminates within the confines of product 81. The volume of propellant designated as 80B also applies pressure to the same volume of product 81 but for the benefit of its own respective spray head 26B.

It is seen therefore, that embodiment 19 will deliver the same product in two different spray patterns.

Figure 5:
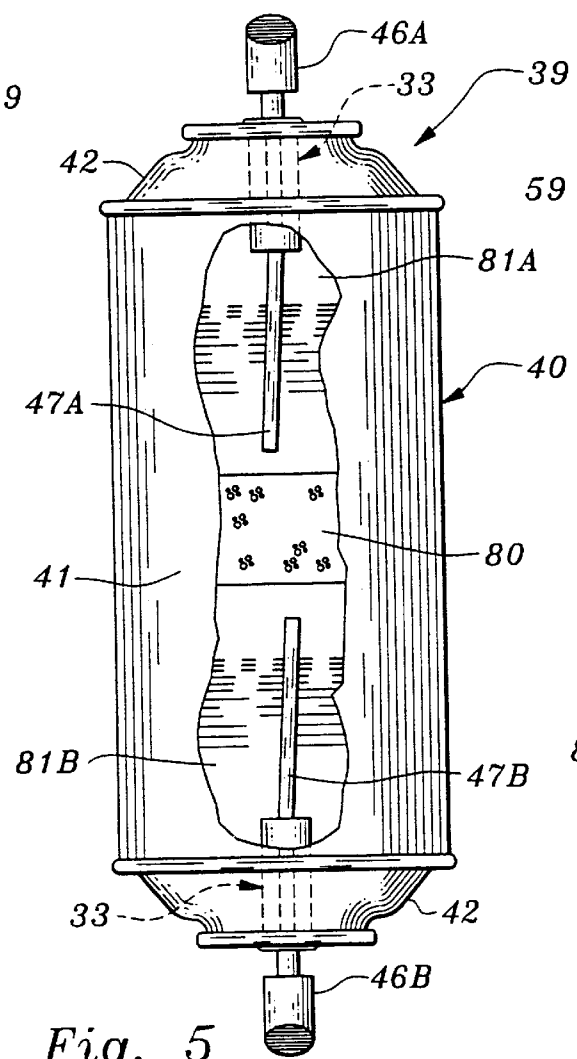
FIG. 5 is an elevational partially cutaway view of a double ended spray can having a centrally disposed propellant with two portions of the same product for delivery on opposite sides of an interposed propellant.

In FIG. 5, a variant of the structure of FIG. 4 is seen. Here the physical portions are the same, the differences being in the contents of the can 40. Thus embodiment 39 has a can whose main body 41 is seen in partial cutaway, in a manner similar to that shown and discussed relative to FIG. 4. Here the respective spray heads 46A, 46B, whose apertures are turned in a direction away from the viewer such as to be unseen, are each connected via their own respective valve 33 to a dip tube 47A and 47B respectively. Dip tube 47A terminates in a first portion of product 81A, while the lower dip tube terminates within a second portion of product 81B. A single portion of propellant 80 is disposed between the portions of product 81A and 81B.

While it would appear to the uninformed that two different products 81A and 81B could perhaps be separated from each other by the presence of this single propellant gas layer 80, and as such an embodiment of that nature is contemplated by the invention, it is readily believed that the ability to maintain segregation between products as each of 81A and 81B gets used up in a myriad of different proportions, would be quite difficult.

Figure 6:
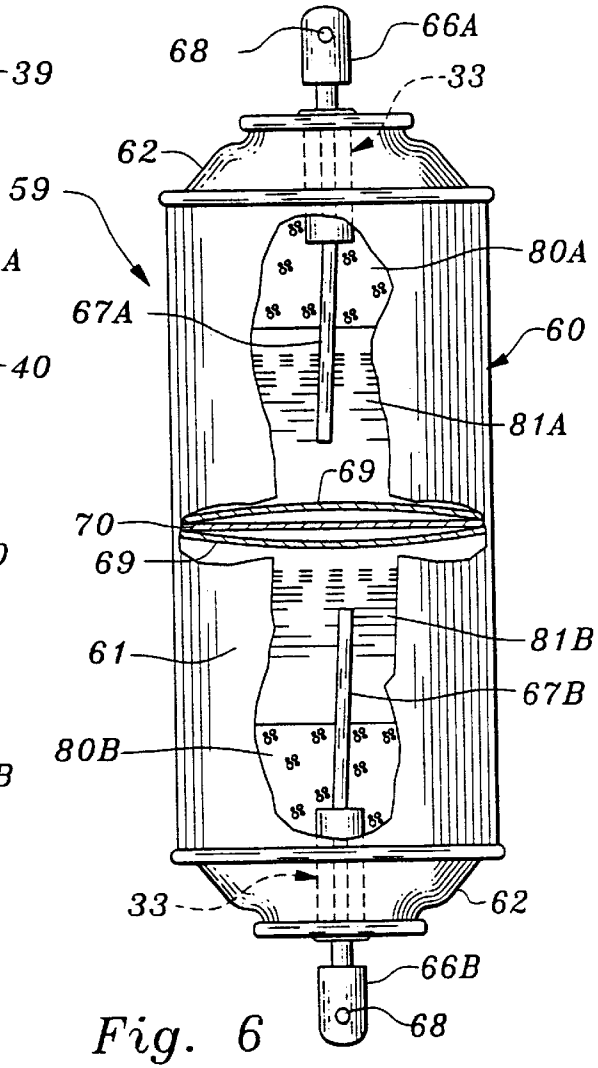
FIG. 6 is an elevational partially cutaway view of a double ended spray can having two centrally disposed products with propellant at each end for delivery, through two nozzles, one adjacent each of the propellant layers.

In the second physical embodiment of this invention, 59, as seen in FIG. 6, the can 60's main body 61 is shown in the same cutaway fashion with the two termini 62 shown not in cutaway. Here the two spray heads 66A, 66B each have the same opening 68. This opening can be circular or fan like or any other configuration known to the art. Both spray heads 66A, 66B can have the same or different apertures 68 as suits the fancy of the operator.

Each spray head 66A, 66B is connected to its respective dip tube 67A, 67B. Dip tube 67A is disposed with a body of fluid 81A, while tube 67B is within a body of a different fluid 81B. Note the different hatching employed to emphasize the distinction. Propellant 80A bears down and applies pressure to product 81A, while propellant 80B applies pressure to product 81B. These two propellants may be the same or different as may be desired. The products are seen to be distinguished here also by different hatching. Of course, the same product can also be employed on both sides of the can with the same or different spray heads.

A barrier-separator 70 usually made of metal, is disposed across the diameter of the main body, usually but necessarily at about the midpoint in the elevation to isolate the product storage area into two distinct chambers. That way the contents of each side can be kept at about the same volume. An optional pressure dome 69 may also be disposed on opposite sides of the separator as is conventionally found in the construction of single spray head aerosol cans.

While the product volumes and the propellant volumes are shown in FIG. 6 to be about equal, there is no criticality to same, and more or less of product and/or propellant of the "A" side of the embodiment, versus the "B" side of the embodiment is fully contemplated.

Figure 7:
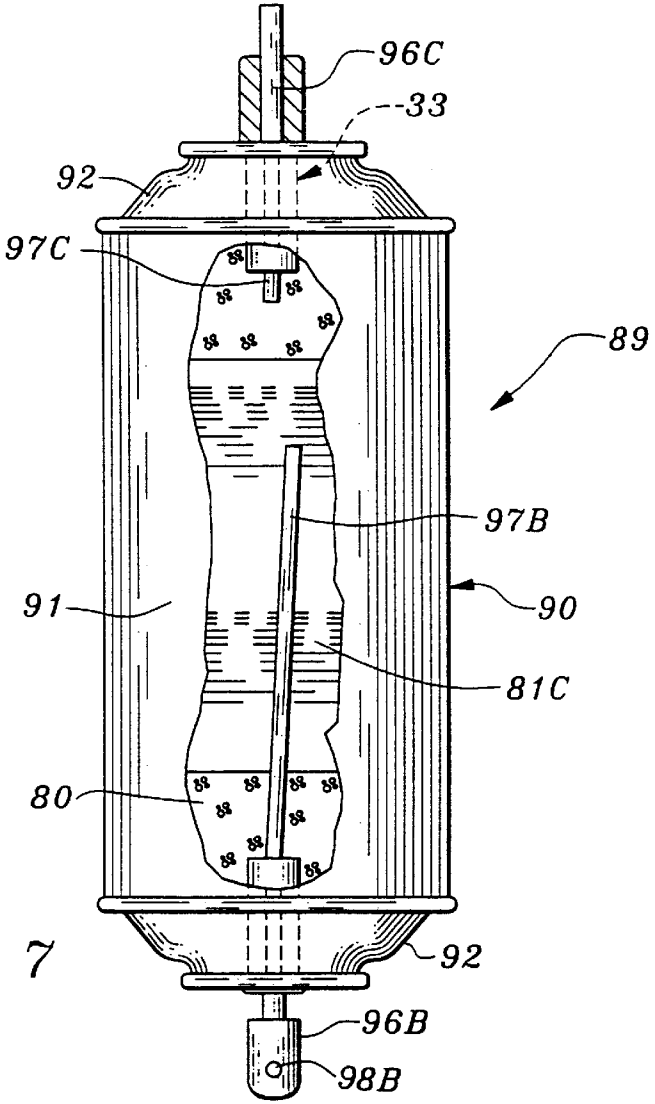
FIG. 7 is an elevational partially cutaway view of the spray can of FIG. 3.

The discussion now moves to FIG. 7, wherein the third embodiment 89, of this invention is seen. Here the can 90 has a main body 91, and two termini portions 92, all of conventional construction. A valve 33 is conventionally disposed at both ends of the can. Disposed in the lower valve is a spray head 96B not unlike head 66B previously discussed. It has an orifice 98B which is similar to other "B" orifices previously discussed in that they will project a droplet spray. At one end, however, the upper end in the drawing of FIG. 7, a straight spray nozzle 96C, of the type used for shaving cream or other foam delivered products is disposed within its valve 33. Whereas spray head 96B has a conventional dip tube 97B attached thereto and which terminates within the product 81C, the spray nozzle 96C extends slightly beyond the valve 33 and has a short dip tube, 97C of a length of about ½ inch to 1 inch attached thereto and which terminates, not within the product, but within the propellant. Therefore when the product exits, it will mix with the propellant and be delivered in a foamaceous state, i.e., with propellant entrained therein. The use of straight through delivery spray nozzle without an elongated dip tube with the head pointing downwardly for foam type products is well understood in the art of single headed aerosol cans.

Figure 8:
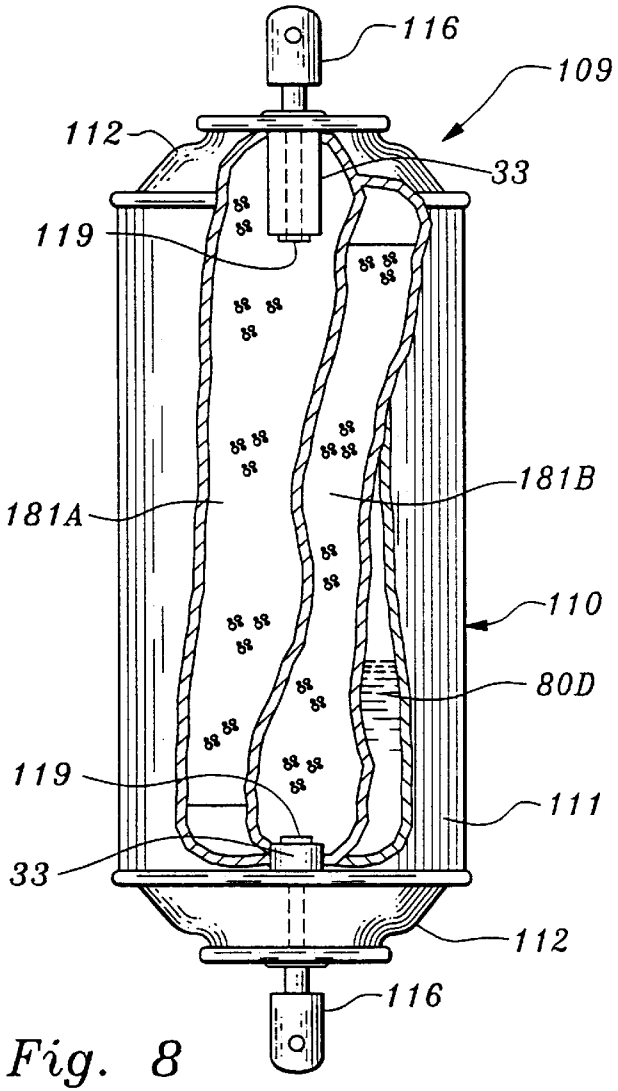
FIG. 8 is a partially cutaway view of a third embodiment of this invention.

The reader's attention is now turned to the fourth embodiment, which is shown in FIG. 8. Here embodiment 109 includes a can 110 having a main body 111 and two termini 112. These terminal portions 112, as well as the other termini are often referred to in the trade as "plugs" and are usually made of annealed aluminum, and are provided either with or without a special coating on the inside surface to resist attack by the product to be delivered.

Each terminal portion includes a spray head disposed therethrough in conventional fashion and connected fluidly to a valve 33. Connected to one valve 33 is a laminated pouch 181A and to the other valve a laminated pouch 181B. The pouches are designated separately to indicate the fact that the product found therein may be the same or different from the companion pouch. Each such pouch includes an entry port 119, which is tubular, but relatively short, and which connects to the valve, to permit flow from the pouch to the respective spray head, 116. Propellant 80D, of any conventional nature is disposed throughout the can 60 and applies a force to each pouch 181A, 181B. Pouches which are devoid of product are available in the marketplace of Intercontinental Packaging Corporation of Tuckahoe, N.Y., and other vendors. These pouches are suitable for carrying products intended for delivery in the format of sprays, liquids, gels and thick creams.

Product-propellant ratios for any all embodiments of this invention can be readily determined by those skilled in the art.

It is seen that I developed a new product that permits the user the opportunity for delivering the same product in two distinct modes from the same can by utilizing different spray heads at each end or terminal portion of the can. My invention also permits the delivery of different complimentary products from the same can, one product from each end. These two products can be the same product in different formats; or different products as may be desired. Each product can be delivered in the same or in a different format from its companion in the same can, dependent upon choice of spray head. The material [product(s)] to be delivered may be stored directly within the can, in a pouch(es) within the can, and in a combination of directly within the can and in a pouch within the can. Thus the material can be in one or two portions.

Thus there may be times when a person is painting, cleaning or lubricating an article, when he or she needs broad coverage of the article with a color, and a few minutes later, needs a confined narrow stream of a the same product as for a handle for the product.

The term "different configuration" as used herein reference to spray heads, is intended to cover both the combination of atomizer head and nozzle, as well as two different shapes of spray such as one being a fan, and one a circle, or one being a liquid jet as is employed for hornet spray, as the user dares not venture close to such an insect. Indeed, for paints, one head could put forth a relatively wide stripe, while the other head puts forth a fine line to touch up any uncovered areas from the stripe head. Any and all of such permutations are intended to be within the scope of the term "different configurations".

Since certain changes may be made in the above apparatus without departing from the scope of the invention herein involved, it is intended that all matter contained in the above description, shall be interpreted as illustrative and not in a limiting sense.

I claim:

1. A product and propellant load aerosol can having a side wall and two terminal ends each with its own valve and product delivery opposite head for the delivery of one of:

a. the same product from each head, and b. different products from the two heads, wherein the material to be delivered is stored in one of:

a. directly within the can, b. in 1 to 2 pouches disposed within said can, c. in a combination storage mode, with one portion of material for delivery stored directly in the can and the other portion of material stored in a pouch disposed in said can;

and wherein the two product delivery heads are one of:

a. of the same head configuration, b. of different head configurations; and further wherein the propellant employed is one of:

a. the same propellant for each delivery head, b. a different propellant for each delivery head.

2. In the aerosol can of claim 1 wherein the material to be delivered is stored in a mode selected from the group consisting of; directly within the can, in at least one pouch within the can, and a combination of directly within the can and in one pouch within the can and at least one propellant is present.

3. In the aerosol can of claim 2 wherein the material to be delivered is stored in two pouches within the can and one propellant is present.

4. In the aerosol can of claim 2 wherein the material to be delivered is stored in two pouches within the can and two different propellants are present.

5. In the aerosol, can of claim 2 wherein at least one material to be delivered is stored directly within the can and two propellants are present at opposite ends of said can.

6. In the double ended aerosol can of claim 1 wherein said can has two different delivery heads, both fluidly connected for delivery of the same product, and wherein one volume of propellant is present in said can.

7. In the double ended aerosol can of claim 1 wherein said can has two different delivery heads, both fluidly connected for delivery of the same product, and wherein two separate volumes of propellant are present in said can.

8. In the double ended aerosol can of claim 7 wherein there is a barrier-separator disposed within the aerosol can.

9. In the double ended aerosol can of claim 1 wherein said can has two different delivery heads, both fluidly connected for delivery of the same product, and wherein one volume of propellant is present in said can, one of said heads being a foam forming nozzle.

10. In the double ended aerosol can of claim 1 wherein both product delivery heads are of the same configuaration, each of which is fluidly connected to a different product to be delivered from said can.

11. In the double ended aerosol can of claim 1 wherein both product delivery heads are of the same configuration, each of which is fluidly connected to the same product to be delivered from said can.

12. In the double ended aerosol can of claim 1 wherein both ends of said can have different delivery heads, each of which is fluidly connected to a different product to be delivered from said can.

13. In the double ended aerosol can of claim 1 wherein both ends of said can have different delivery heads, each of which is fluidly connected to the same product to be delivered from said can.

14. In the double ended aerosol can of claim 1 wherein both ends of said can have different delivery heads, each of which is fluidly connected to a different product to be delivered from said can, both of which products are stored in separate pouches.

15. In the double ended aerosol can of claim 1 wherein both ends of said can have different delivery heads, each of which is fluidly connected to a different product to be delivered from said can both of which products are stored directly in the can, and wherein a physical separator isolates one product from the other within said can.

16. An empty aerosol can having a side wall and two opposite terminal ends each with its own valve and product delivery head for the delivery of:

a. the same product from each head, b. different products from the two heads, said can having 1 to 2 pouches disposed within said can from which the material to be delivered is to be stored, and wherein the two product delivery heads are either of:

a. of the same head configuration, b. of different head configurations.

17. The empty aerosol can of claim 7 wherein one product delivery head is a foam forming nozzle.

18. The empty aerosol can of claim 16 wherein both product delivery heads are of the same configuration, and two pouches for product are present.

19. An empty aerosol can having a side wall and two opposite terminal ends each with its own valve and product delivery head for the delivery of:

a. the same product from each head, b. different products from the two heads, said can having storage space within said can from which the material to be delivered is to be stored, and wherein the two product delivery heads are either of:

a. of the same head configuration, b. of different head configurations.

20. The empty double ended aerosol can of claim 19 wherein the two product delivery heads are of the same configuration.

21. The empty double ended aerosol can of claim 19 wherein the two product delivery heads are of different configurations.

22. The empty aerosol can of claim 21 wherein one product delivery head is a foam forming nozzle.

23. An empty aerosol can having a side wall and two opposite terminal ends each with its own valve and product delivery head;

said can having storage space within said can from which the material to be delivered is to be stored, and wherein the two product delivery heads are either of:

a. of the same head configuration, b. of different head configurations;

the storage area for product being divided by a physical separator to form two chambers.

24. An aerosol can having a side wall and two opposite terminal ends each with its own valve and product delivery head, for the delivery of 1 to 2 products within said can by propellant stored in said can, said can having 1 to 2 volumes of propellant for the delivery of material stored in said can.

* * * * *